US006273412B1

(12) United States Patent
Sussmeier et al.

(10) Patent No.: US 6,273,412 B1
(45) Date of Patent: Aug. 14, 2001

(54) LOWER ENVELOPE TRANSPORT MOUNTING AND ADJUSTING APPARATUS

(75) Inventors: John W. Sussmeier, Cold Spring, NY (US); Carlos L DeFigueiredo, Sandy Hook, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/476,006

(22) Filed: Dec. 29, 1999

(51) Int. Cl.[7] ..... B65H 5/00

(52) U.S. Cl. ..... 271/2; 271/9.13; 271/264; 198/586; 198/861.1

(58) Field of Search ..... 270/58.06; 271/2, 271/9.13, 264; 198/589, 861.1

(56) References Cited

U.S. PATENT DOCUMENTS

| | | | | |
|---|---|---|---|---|
| 3,748,442 | * | 7/1973 | Lovendusky | 271/264 |
| 4,099,607 | * | 7/1978 | Brennan et al. | 198/586 X |
| 4,194,633 | * | 3/1980 | Paterson et al. | 198/586 X |
| 4,349,097 | * | 9/1982 | Curti | 198/586 X |
| 4,512,562 | * | 4/1985 | Moll | 271/98 X |
| 4,748,740 | * | 6/1988 | Buck et al. | 198/586 X |
| 4,930,623 | * | 6/1990 | Johnson et al. | 198/860.1 X |
| 5,149,081 | * | 9/1992 | Greive | 198/586 X |
| 5,197,590 | * | 3/1993 | Prim et al. | 198/586 X |
| 5,392,710 | * | 2/1995 | Li | 271/264 X |
| 6,086,061 | * | 7/2000 | Vedoy et al. | 271/3.01 |

* cited by examiner

*Primary Examiner*—Christopher P. Ellis
*Assistant Examiner*—Patrick Mackey
(74) *Attorney, Agent, or Firm*—Michael J. Cummings; Michael E. Melton

(57) ABSTRACT

A mounting assembly for mounting a lower envelope transport onto a chassis of an envelope insertion station. The mounting assembly includes mechanisms for a three-plane adjustment in XYZ directions so that the positioning relationship between the lower envelope transport and the envelope staging area in the envelope insertion station can be adjusted to achieve a desired distance at the hand-over point. Furthermore, the mounting assembly allows the lower envelope transport to be removed from the chassis for jam access, maintenance or shipping purposes. The lower envelope transport can be remounted onto the envelope insertion station without the need for readjusting its position to achieve the desired distance in the XYZ directions at the hand-over point.

9 Claims, 4 Drawing Sheets

LOWER ENVELOPE TRANSPORT MOUNTING AND ADJUSTING APPARATUS

TECHNICAL FIELD

The present invention relates generally to an envelope insertion machine and, more particularly, to an envelope transport which supplies envelopes to an envelope inserting station in the envelope inserting machine.

BACKGROUND OF THE INVENTION

In a typical mail inserting system, there is an envelope feeder on one end of the system that sequentially releases envelopes into the envelope insertion station. On the other end of the inserting system, there is a gathering section where enclosure material is released and gathered. If the enclosure material contains a number of documents, the documents are separately released from a plurality of enclosure feeders. The released documents are then collated into a stack and moved into the envelope insertion station where the document stack is inserted into the envelope. In some mail inserting systems, envelopes are not released directly into the envelope insertion station. Rather, envelopes are released in another section of the inserting system and then moved into the envelope insertion station in order to improve the efficiency of the inserting system. In these mail inserting systems, envelopes are typically fed from below the envelope insertion station and the flap of each envelope is opened as it is transported to an envelope staging area of the envelope insertion station. The transport mechanism which is used to move the envelopes below the staging area is referred to as the lower transport.

The envelope lower transport is a separate mechanical assembly from the envelope insertion station. When an envelope is transported from the lower transport to the staging area, it moves through a gap between the two machine parts. The gap is referred to as a hand-over point and its physical dimensions are very critical. Thus, the relative position o:f the lower transport must be precisely aligned with the staging area so as to achieve the correct dimensions of the hand-over point. It is, therefore, advantageous and desirable to provide a mounting apparatus with all the necessary adjustment mechanism for mounting and adjusting the lower transport. Furthermore, the lower transport is designed such that it can be detached from the envelope insertion station for jam access, maintenance and shipping purposes. In order to retain the alignment of the lower transport relative to the staging area after it is detached from and remounted on the envelope insertion station, the mounting assembly also must have means to ensure that the alignment is not lost due to the detaching, shipping and remounting processes.

SUMMARY OF THE INVENTION

The present invention provides a mounting assembly for mounting a lower envelope transport onto a chassis of an envelope insertion station, wherein the chassis has a plurality of seating holes on its upper surface and the relative position between the chassis and the envelope staging area is fixed.

The mounting assembly includes mechanisms for a three-plane adjustment in XYZ directions so that the positioning relationship between the lower envelope transport and the envelope staging area in the envelope insertion station can be adjusted to achieve a desired distance at the hand-over point. Furthermore, the mounting assembly allows the lower envelope transport to be removed from the chassis for jam access, maintenance or shipping purposes. In accordance with the present invention, the lower envelope transport can be remounted onto the envelope insertion station without the need for readjusting its positions to achieve the desired distance in the XYZ directions at the hand-over point.

The mounting assembly includes: a base plate having an upper surface and a lower surface facing the upper surface of the chassis; a plurality of bushings fixedly mounted on the base plate, wherein each bushing has a base part extending out of the lower surface of the base plate for fitting in one of the seating holes of the chassis, wherein each bushing has a threaded hole accessible from the upper surface of the base plate; a first locking mechanism to secure the base plate to the chassis at a fixed position; a mounting plate having an upper surface and a lower surface; a plurality of jack screws, each mounted on the threaded hole of a bushing, wherein each jack screw has an upper surface for supporting the lower surface of the mounting plate, and wherein the mounting of the jack screws on the threaded hole of the bushing is adjustable so as to achieve a desirable distance of the hand-over point in the Y direction; an adjustment block fixedly mounted on the mounting plate; an adjustment bracket fixedly mounted on the base plate; an adjustment screw for engaging the adjustment bracket to the adjustment block so that the distance between the adjustment bracket and the adjustment block is adjustable so as to achieve a desirable distance of the hand-over point in the X direction; a mounting bracket for mounting the lower envelope transport in a fixed position; a second locking mechanism for securing the mounting bracket to the mounting base, wherein the locking mechanism is adjustable to achieve a desirable distance of the hand-over point in the Z direction; and a third locking mechanism for securing the base plate to the mounting plate in order to maintain the desired distance of the hand-over point in the X and Y directions.

Preferably, each jack screw has a threaded hole through the upper surface of the jack screw, and the mounting plate further comprises a plurality of slots, each slot being in alignment with the threaded hole of one respective jack screw, so as to allow a plurality of locking screws to engage with the thread holes of the jack screws in order to secure the mounting base to the base plate thereby maintaining the critical setting in the Y direction and the X direction.

With the above described mounting assembly, the lower envelope transport is removable from the mounting assembly by disengaging the lower envelope transport from the mounting bracket without altering the critical setting in the XYZ directions. Thus, when the lower envelope transport is remounted on the mounting bracket, there is no need to adjust the jack screws, the adjustment screw and the mounting screw to re-establish the critical setting in the X, Y and Z directions.

Preferably, the base plate further includes a plurality of through holes, each being aligned with a threaded hole on the upper surface of the chassis to allow a plurality of securing screws to secure the base place to the chassis at a fixed position. Thus, the mounting assembly can be mounted on the chassis at a fixed position, allowing the mounting assembly to be removed from the chassis without losing the critical setting between the lower envelope transport and the envelope engaging area.

The mounting assembly of the present invention will become apparent upon reading the description taken in conjunction with FIGS. 1 to 4.

DETAILED DESCRIPTION

Figure 1:
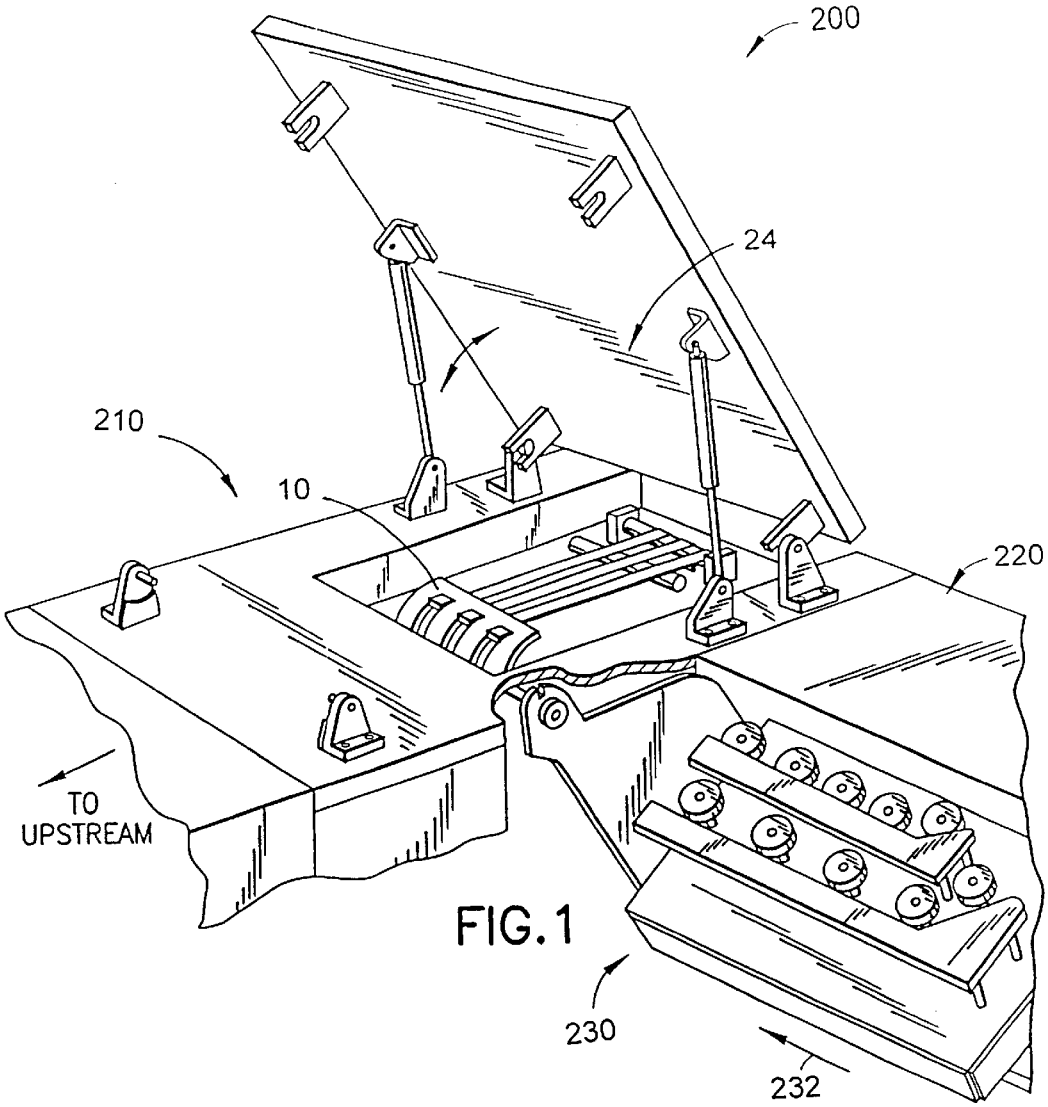
FIG. 1 is a perspective view showing a section of a mail inserting system.

FIG. 1 illustrates a section of a mail inserting system 200, showing an envelope insertion station 210 having an envelope staging area 24 where enclosure material (not shown) gathered at the upstream end of the mail inserting system 200 is inserted into an envelope (not shown). Also shown in FIG. 1 is a section of an envelope feeder 220 and an envelope supply path system 230. When in use, the envelope supply path system 230 must be pushed along a direction 232 so that the envelope supply path system 230 is placed directly under the envelope staging area 24. Between the envelope supply path system 230 and the envelope staging area 24, there is a lower transport 10 for moving the envelopes Ads from the envelope supply path system 230 to the envelope staging area 24. A section of the lower transport 10 can be seen in FIG. 1.

Figure 2:
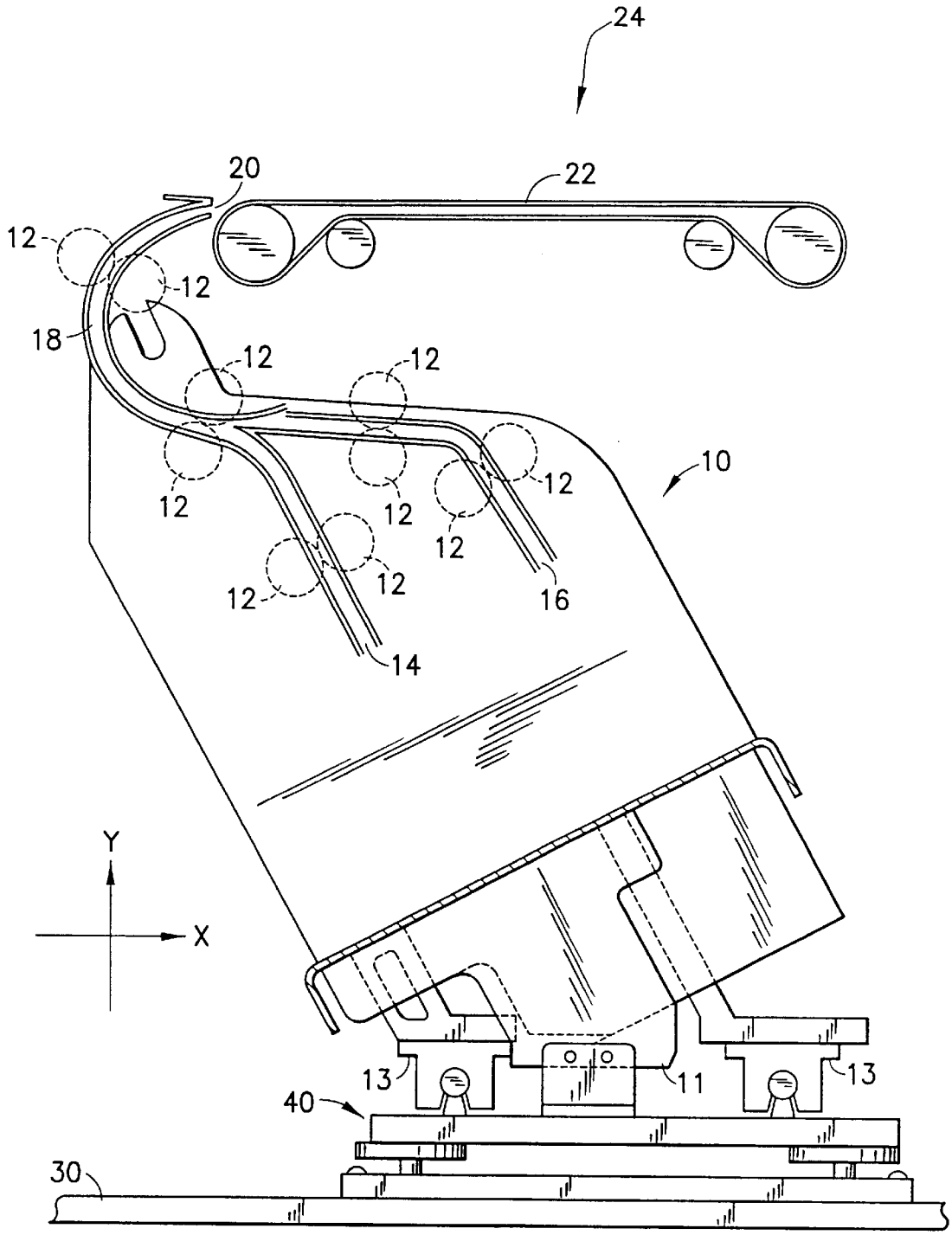
FIG. 2 is a schematic representation showing the relative position of the lower transport to the envelope staging area.

FIG. 2 shows the position of the lower transport 10 relative to the envelope staging area 24 in the envelope insertion station 210. As shown, the lower transport 10 has a plurality of rollers 12 for guiding envelopes through envelope channels 14, 16, 18 to a hand-off point 20 where envelopes will be driven away from the lower transport 10 by a take-away belt 22 in the envelope staging area 24. The lower transport 10 is mounted on a chassis 30 of the envelope insertion station 210 via an interconnecting mounting assembly 40. Because the position of the hand-off point 20 is very critical for feeding envelopes to the envelope stage area 24, it requires a three-plane adjustment (in XYZ directions) to place the lower transport 10 at the proper position relative to the take-away belt 22 in the envelope staging area 24. The necessary three-plane adjustment to achieve the desired hand-off point 20 is hereafter referred to as the critical setting.

Figure 3:
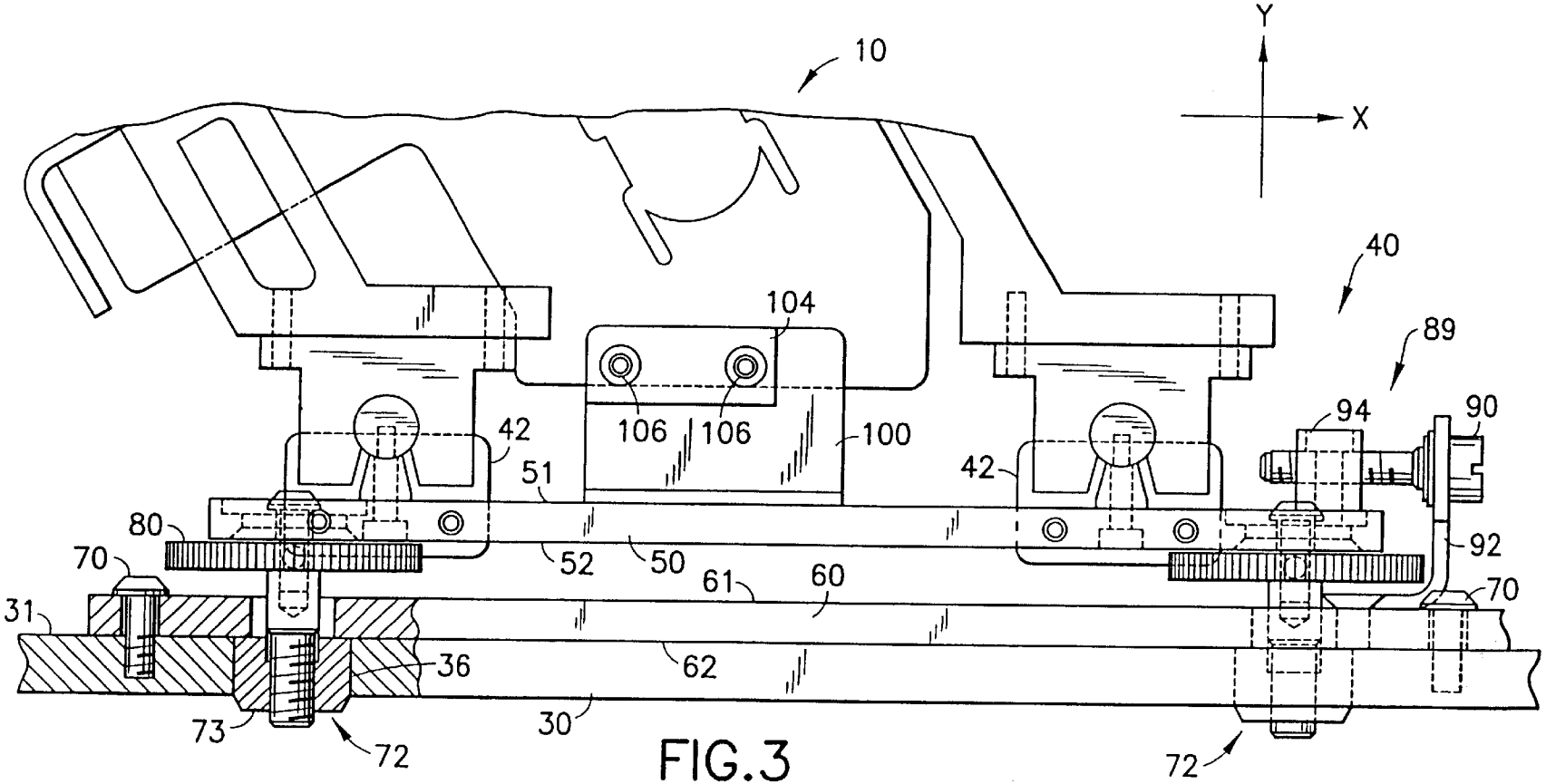
FIG. 3 is a plane view showing the mounting assembly located between the lower transport and a mounting chassis of the envelope insertion station.

FIG. 3 illustrates the mounting assembly 40 for mounting the lower transport 10 to the chassis 30 of an envelope insertion station 210. As shown in FIG. 3, the major supporting components in the mounting assembly 40 are a base plate 60 to be mounted directly on the chassis 30, and a mounting plate 50 which is supported by a plurality of jack screws 80. A plurality of bushings 72 are fixedly mounted on the base plate 60 and each bushing 72 fits in one of the seating holes 36 on the chassis 30. Each of the bushings 72 is used to mount a jack screw 80.

The lower transport 10 is mounted on the mounting plate 50 via a mounting bracket 106 together with a mounting block 100 and mounting screws 106. The three-plane adjustment is provided by an adjustment assembly 89, the jack screws 80 and the mounting block 100. The adjustment assembly 89 includes an adjustment bracket 92 together with an adjustment block 94 and an adjustment screw 90. The mounting is secured by a plurality of screws 84 and 70. The screws 84 are used to secure the mounting plate 50 to the jack screws 80, and the screws 70 are used to secure the base plate 60 to the chassis 30. Further support for the lower transport 10 is provided by mounting blocks 42.

Figure 4:
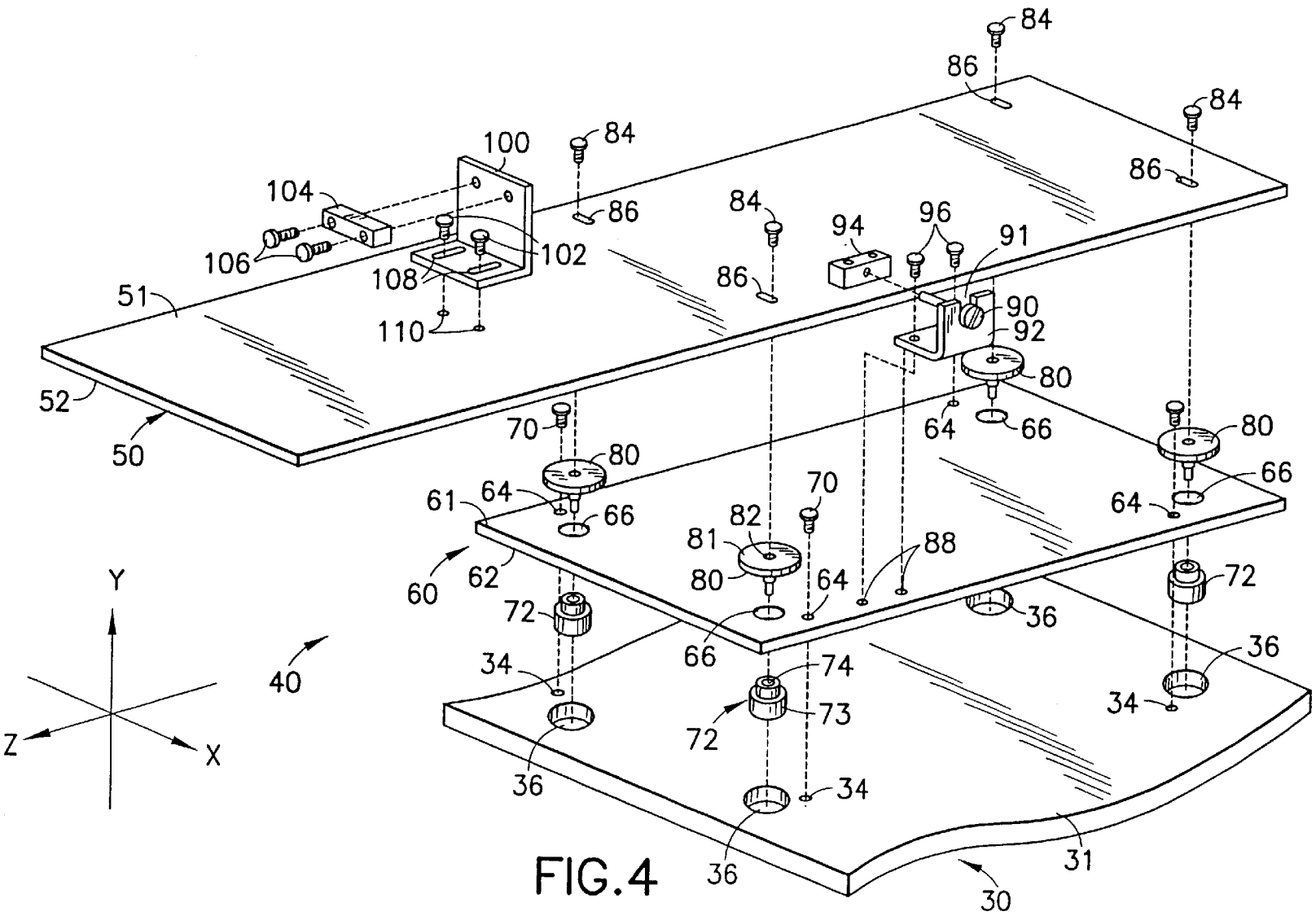
FIG. 4 is an exploded view showing the mechanical components of the mounting assembly, according to the present invention.

The details of the mounting assembly 40 are shown in an exploded view as illustrated in FIG. 4.

As shown in the exploded view of FIG. 4, the chassis 30 has a plurality of seating holes 36 and a plurality of threaded holes 34 on the upper surface 31 of the chassis 30. A plurality of bushings 72 are fixedly mounted on the base plate 60 from the lower surface 62 of the base plate 60. Each bushing 72 has a base part 73 extending out of the lower surface 62 of the base plate 60 for fitting in one of the seating holes 36 of the chassis 30. The threaded holes 34 on the chassis 30, together with a plurality of screws 70 are used to lock the base plate 60 to the chassis 30 such that the lower surface 62 of the base plate 60 is placed in contact with the upper surface 31 of the chassis 30. Each bushing 72 has a thread bushing hole 74 accessible from the upper surface 61 of the base plate 60. A plurality of jack screws 80, each of which is mounted on the bushing hole 74 of a bushing 72, is used to support the lower surface 52 of the mounting plate 50. The mounting of the jack screws 80 on the respective bushing holes 74 is adjustable so that the critical setting in the Y direction can be achieved. As shown in FIG. 4, the adjustment block 94 is fixedly mounted on the upper surface 51 of the mounting plate 50, and the adjustment bracket 92 is fixedly mounted on the upper surface 61 of the base plate 60 with a plurality of screws 96 through the threaded holes 88. The adjustment block 94 has a threaded hole 95. The adjustment bracket 92 has an open slot 91 to allow an adjustment screw 90, which is mounted on the threaded hole 95, to adjust the distance between the adjustment block 94 and the adjustment bracket 92 in order to achieve the critical setting in the X direction. The mounting bracket 100 has two slots 108 running in the Z direction for mounting the mounting bracket 100 on the mounting plate 50 with two screws 102 through threaded holes 110. The mounting bracket 100, together with the mounting blocks 104 and the screws 106 are used to mount the lower transport 10 in a fixed position as shown in FIG. 3. The slots 108 allow the position of the lower transport 10 relative to the mounting plate 50 to be adjustable so as to achieve the critical setting in the Z direction.

Each jack screw 80 has on its upper surface 81 a threaded hole 82 and the mounting plate 50 has a plurality of slots 86 running in the X direction. The threaded holes 82 and the slots 86, together with a plurality of screws 84, are used to lock the mounting plate 50 to the jack screws 80, thereby securing the mounting plate 50 to the base plate 60 in order to maintain the critical setting in the Y direction and the X direction.

After the lower transport 10 is mounted on the chassis 30 of an envelope insertion station 210 via the interconnecting mounting assembly 40 and the mounting bracket 100, the hand-off point 20 between the lower transport 100 and the envelope staging area 24 (FIG. 1) can be adjusted in a number of steps as shown below. The adjustment must be made before the locking screws 84 are used to secure the mounting plate 50 to the jack screws 80. However, the adjustment can be made regardless of whether the locking screws 70 are used to secure the base plate to the chassis 30. The adjustment steps are as follows:

1) adjusting each jack screw 80 until the exit end of the envelope channel 18 of the lower transport 10 (FIG. 2) at the hand-over point 20 is positioned at the right height relative to the take-away belt 22;
2) adjusting the adjustment screw 90 to vary the distance between the adjustment bracket 92 and the adjustment block 94 until the gap at the hand-over 20 reaches a specified dimension; and
3) adjusting the mounting bracket 100 relative to the mounting plate 50 by loosening the screws 102 until the critical setting is reached and the screws 102 should be properly tightened afterward.

When the adjustment in the three planes is done, the critical setting can be maintained by locking the mounting plate 50 to the jack screws 80 with the screws 84.

Before the envelope insertion station is used, the entire mounting assembly 40 must be secured to the chassis 30 by properly tightening the screws 70.

If there is a need to remove the lower transport 10 from the envelope insertion station for jam clearing, maintenance or shipping purposes, the lower transport 10 can be removed by disengaging the mounting block 104 from the mounting bracket 100, without disturbing the adjustments on the mounting bracket 100 relative to the mounting plate 50. The lower transport 10 can be remounted simply by securing it between the mounting block 104 and the mounting bracket 100.

Because the mounting of the lower transport 10 to the mounting bracket 100 is not adjustable, the critical setting for the hand-off point 20 can be preserved, so long as the locking screws 84 are not loosened from the jack screws 80. Furthermore, after the lower transport 10 is removed from the mounting assembly 40, the entire mounting assembly 40 can also be removed from the envelope insertion station by removing the locking screws 70 which secure the base plate 60 from the chassis 30. Because the mounting of the base plate 60 and the chassis 30 is not adjustable, the critical setting is not lost after the mounting assembly 40 is remounted onto the chassis 30.

Thus, what has been described is a mounting assembly for mounting a lower transport to an envelope insertion station, wherein the relative position of the lower transport to the envelope staging area of the envelope insertion station can be adjusted in the XYZ directions. Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A mounting assembly for mounting a lower envelope transport onto a chassis of an envelope insertion station having an envelope staging area, wherein the lower envelope transport has a critical position relative to the envelope staging area in X, Y and Z directions and wherein the lower envelope transport is allowed to be removed from and remounted on the envelope insertion station without affecting the critical position, said mounting assembly comprises:

a base plate having an upper surface and a lower surface facing the chassis;

a plurality of bushings fixedly mounted on the base plate, wherein each bushing has a base part extending out of the lower surface of the base plate and each bushing has a threaded hole accessible from the upper surface of the base plate;

a mounting plate having an upper surface and a lower surface;

a plurality of jack screws, each mounted on the threaded hole of a bushing, wherein each jack screw has an upper surface to support the lower surface of the mounting plate to define a distance between the upper surface of the base plate and the lower surface of the mounting plate in the Y direction, and wherein the mounting of the jack screws on the threaded hole of the bushing is adjustable so as to adjust the distance between the upper surface of the base plate and the lower surface of the mounting plate in order to achieve the critical position in the Y direction;

an adjustment assembly mounted between the mounting plate and the base plate for moving the mounting plate relative to the base plate in the X direction in order to achieve the critical position in the X direction;

a mounting bracket for mounting the lower transport in a fixed position;

a bracket mounting device for mounting the mounting bracket to the mounting plate; and a bracket adjustment device to adjust the mounting position of the mounting bracket so as to achieve the critical position in the Z direction, wherein the lower transport is removable from the mounting assembly by disengaging the lower transport from the mounting bracket.

2. The mounting assembly of claim 1, further comprising a locking mechanism to secure the base plate to the chassis at a fixed position.

3. The mounting assembly of claim 2, wherein the locking mechanism can be removed from the mounting assembly so as to allow the base plate to be removed from the chassis.

4. The mounting assembly of claim 1, further comprising a bracket locking device for securing the mounting bracket to the mounting plate.

5. The mounting assembly of claim 1, wherein each jack screw has a threaded hole through the upper surface thereof, and the mounting plate has a plurality of through holes so as to allow a plurality of securing screws to engage with the threaded holes through the through hole in order to secure the mounting plate to the jack screws.

6. The mounting assembly of claim 1, wherein the chassis has a plurality of seating holes so as to allow the base part of each bushing to fit in one of the seating holes in order to maintain a fixed position between the base plate and the chassis.

7. The mounting assembly of claim 1, wherein the adjustment assembly comprises:

an adjustment block fixedly mounted on the mounting plate;

an adjustment bracket fixedly mounted on the base plate to define a distance between the adjustment block and the adjustment bracket; and an adjustment screw for engaging the adjustment block to the adjustment bracket in order to adjust the distance between the adjustment block and the adjustment bracket.

8. The mounting assembly of claim 7, wherein the adjustment block has a threaded hole, and the adjustment bracket has an aperture so as to allow the adjustment screw to engage with the threaded hole of the adjustment block through the aperture of the adjustment bracket.

9. The mounting assembly of claim 1, wherein the chassis has a plurality of threaded holes and the base plate has a plurality of through holes so as to allow a plurality of securing screws to secure the base plate to the chassis.

* * * * *